US006874433B2

(12) United States Patent
Lin

(10) Patent No.: US 6,874,433 B2
(45) Date of Patent: Apr. 5, 2005

(54) INCINERATOR WITH AN AIR DISTRIBUTOR MOUNTED IN A FURNACE THEREOF

(76) Inventor: Dai-You Lin, 10F-1, No. 48, Wu-Chuan Wu St., Hsi Dist., Taichung City (TW)

( * ) Notice: Subject to any disclaimer, the term of this patent is extended or adjusted under 35 U.S.C. 154(b) by 2 days.

(21) Appl. No.: 10/618,046

(22) Filed: Jul. 11, 2003

(65) Prior Publication Data

US 2005/0005828 A1 Jan. 13, 2005

(51) Int. Cl.[7] ..... F23B 5/00; F23G 7/06

(52) U.S. Cl. ..... 110/213; 110/214; 110/251

(58) Field of Search ..... 110/214, 252, 251, 110/210, 308, 314, 182.5, 213, 345

(56) References Cited

U.S. PATENT DOCUMENTS

| | | | | |
|---|---|---|---|---|
| 1,545,497 | A * | 7/1925 | Kener, Jr. | 110/187 |
| 4,674,417 | A * | 6/1987 | Hoskinson | 110/214 |
| 5,156,097 | A * | 10/1992 | Booth et al. | 110/214 |
| 5,341,637 | A * | 8/1994 | Hamrick | 60/39.464 |
| 6,363,868 | B1 * | 4/2002 | Boswell et al. | 110/213 |

* cited by examiner

*Primary Examiner*—Kenneth Rinehart
(74) *Attorney, Agent, or Firm*—Sheridan Ross PC

(57) ABSTRACT

An incinerator includes a furnace defining a combustion chamber, a feed supply, a feed-delivering conduit connected to the feed supply and the furnace, an air supply connected to the furnace, and an air distributor disposed in the combustion chamber, connected to the air supply, and having an elongated segment which is formed with a plurality of spaced apart holes for uniformly distributing air into the combustion chamber.

4 Claims, 4 Drawing Sheets

INCINERATOR WITH AN AIR DISTRIBUTOR MOUNTED IN A FURNACE THEREOF

BACKGROUND OF THE INVENTION

1. Field of the Invention

This invention relates to an incinerator with an air distributor mounted in a furnace thereof.

2. Description of the Related Art

Conventional incinerators for incinerating agricultural solid wastes, such as rice hulls, normally include a furnace, and an air supply for delivering air into a combustion chamber in the furnace for combustion of the solid wastes. The combustion chamber normally includes a primary combustion chamber and a secondary combustion chamber for completely burning the combustion gases that result from the combustion of the solid wastes in the primary combustion chamber. The conventional incinerator is disadvantageous in that non-uniform air distribution tends to occur in the secondary combustion chamber, which results in incomplete burning of the combustion gases and which can produce undesired smoke and pollute the environment.

SUMMARY OF THE INVENTION

Therefore, the object of the present invention is to provide an incinerator that is capable of overcoming the aforesaid drawback of the prior art.

According to the present invention, there is provided an incinerator that comprises: a furnace that defines a combustion chamber therein; a feed supply adapted for containing solid wastes therein; a feed-delivering conduit connected to the feed supply and the furnace so as to permit delivery of the solid wastes into the combustion chamber; an air supply connected to the furnace for supplying air into the combustion chamber; and an air distributor that is disposed in the combustion chamber, that is connected to the air supply, and that has an elongated segment which extends in a longitudinal direction the same as a flow direction of combustion gases in the combustion chamber, and which is formed with a plurality of spaced apart holes distributed along the longitudinal direction. Each of the holes opens in a transverse direction relative to the longitudinal direction so as to permit uniform distribution of air into the combustion chamber.

BRIEF DESCRIPTION OF THE DRAWINGS

In drawings which illustrate embodiments of the invention.

DETAILED DESCRIPTION OF THE PREFERRED EMBODIMENTS

Figure 1:
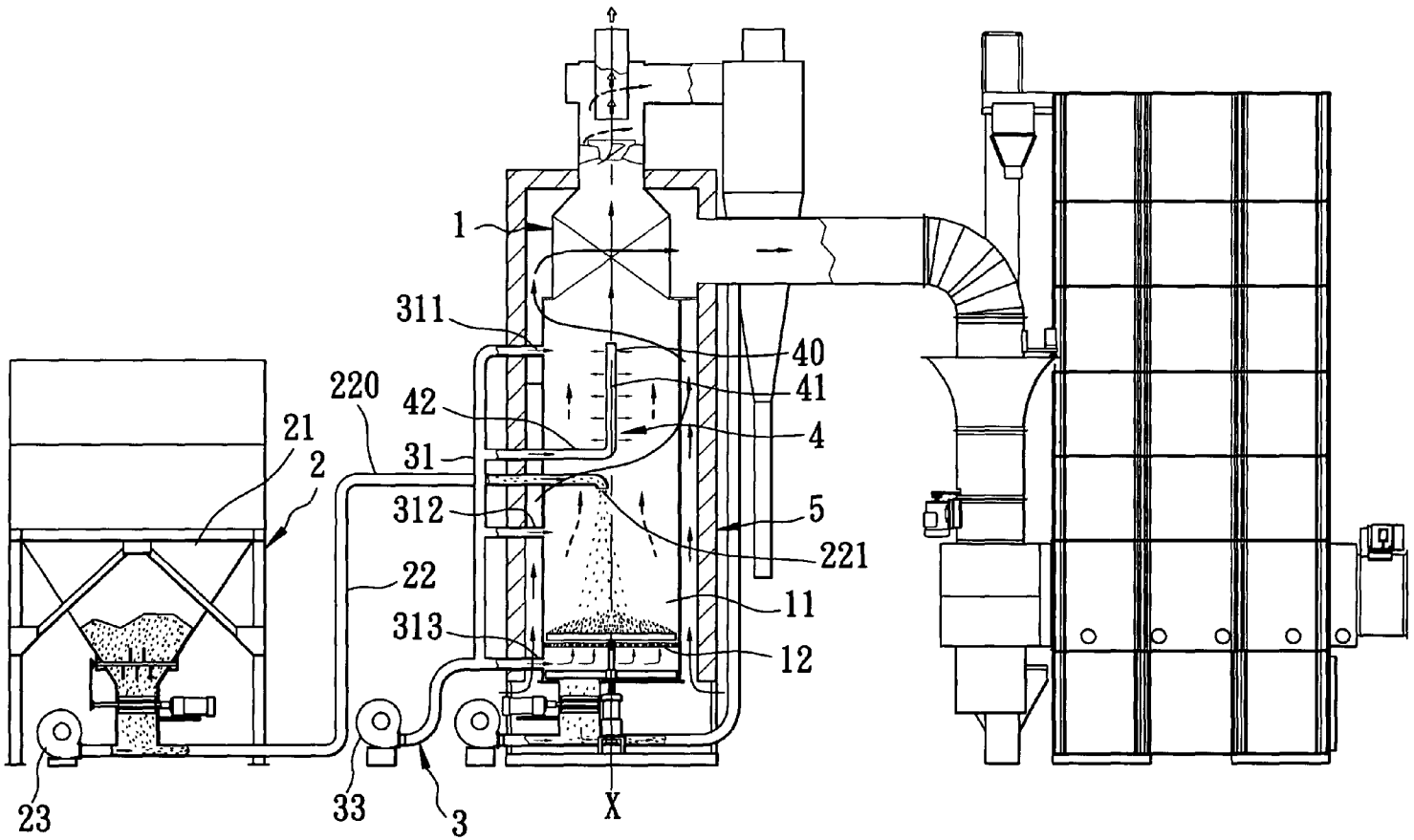
FIG. 1 is a schematic partly sectional view of the first preferred embodiment of an incinerator according to the present invention.

For the sake of brevity, like elements are denoted by the same reference numerals throughout the disclosure.

Figure 2:
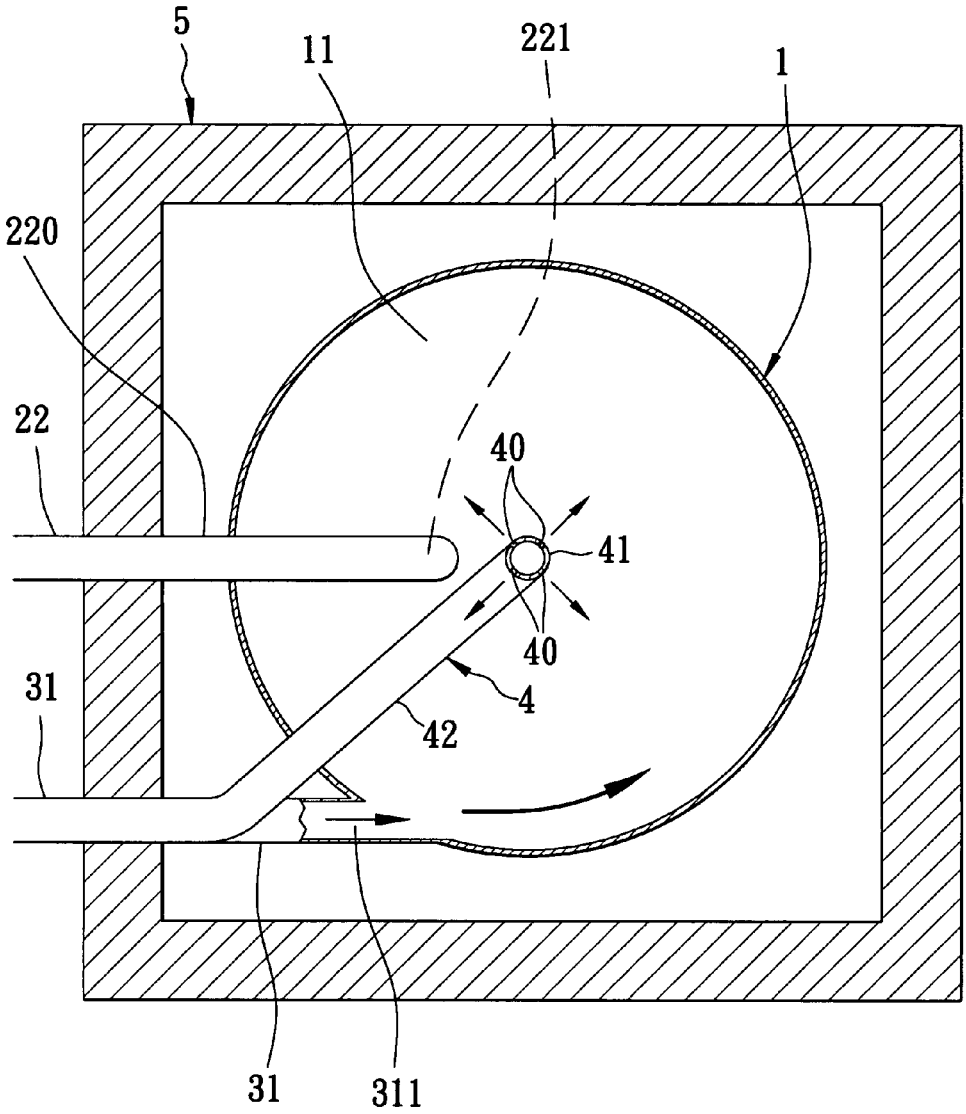
FIG. 2 is a schematic fragmentary top sectional view to illustrate how air is distributed through an air distributor in a furnace of the incinerator of FIG. 1.

FIGS. 1 and 2 illustrate the first preferred embodiment of an incinerator for incinerating agricultural solid wastes, such as rice hulls, according to this invention. The incinerator includes: a furnace 1 that defines a combustion chamber 11 therein and a center line (X); a heat-insulating shield 5 surrounding and spaced apart from the furnace 1; a feed supply 2 including a hopper 21 for containing the solid wastes therein, and a feed blower 23 for delivering the solid wastes; a feed-delivering conduit 22 connected to the hopper 21 and the furnace 1 so as to permit delivery of the solid wastes into the combustion chamber 11; an air supply 3 connected to the furnace 1 for supplying air into the combustion chamber 11, and including an air blower 33 and an air conduit 31 that is connected to the air blower 33 and the furnace 1; an air distributor 4 that is disposed in the combustion chamber 11, that is connected to the air supply 3, and that is in the form of an L-shaped pipe, the air distributor 4 having an elongated segment 41 which extends in a longitudinal direction the same as a flow direction of combustion gases in the combustion chamber 11, which has top and bottom ends, and which is formed with a plurality of spaced apart holes 40 distributed along the longitudinal direction. Preferably, the elongated segment 41 of the air distributor 4 extends along the center line (X) of the furnace 1. Each of the holes 40 in the elongated segment 41 of the air distributor 4 opens in a transverse direction relative to the longitudinal direction so as to permit uniform distribution of air into the combustion chamber 11. The air distributor 4 further has a transverse segment 42 that extends from the bottom end of the longitudinal segment 41 in the transverse direction to connect with the air conduit 31.

The feed-delivering conduit 22 has a laterally extending segment 220 that extends in the transverse direction through the furnace wall 1, and that has a feed-discharging end 221 disposed in the combustion chamber 11 and opening downwardly. The transverse segment 42 of the air distributor 4 is disposed above the feed-discharging end 221. The elongated segment 41 of the air distributor 4 extends upwardly from the transverse segment 42 in the longitudinal direction away from the feed-discharging end 221 of the laterally extending segment 220 of the feed-delivering conduit 22.

A waste-supporting rack 12 is mounted in a lower end of the combustion chamber 11 for holding the solid wastes falling from the feed-discharging end 221 of the laterally extending segment 220 of the feed-delivering conduit 22. The furnace 1 is formed with spaced apart first, second, and third air inlets 311, 312, 313 which are connected to the air conduit 31. The first air inlet 311 is disposed at an elevation substantially the same as that of the top end of the elongated segment 41 of the air distributor 4. The second air inlet 312 is disposed at an elevation below the feed-discharging end 221 of the laterally extending segment 220 of the feed-delivering conduit 22. The combustion gases resulting from burning of the solid wastes flow upwardly from the waste-supporting rack 12 into the region where the air distributor 4 is located to mix with air that exits from the air distributor 4 so as to undergo a secondary combustion and so as to permit complete burning thereof.

Figure 3:
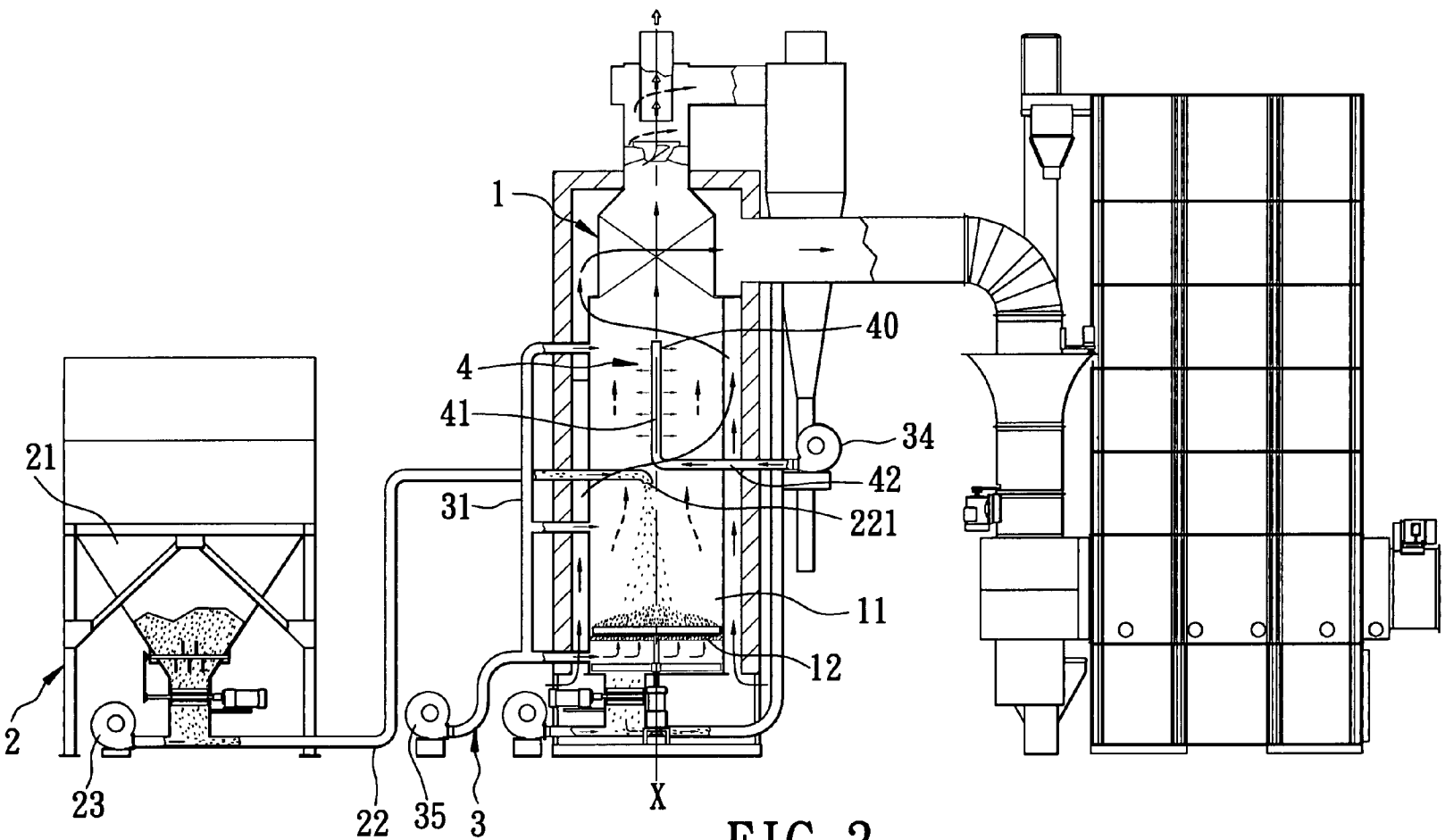
FIG. 3 is a schematic partly sectional view of the second preferred embodiment of the incinerator according to the present invention.
Figure 4:
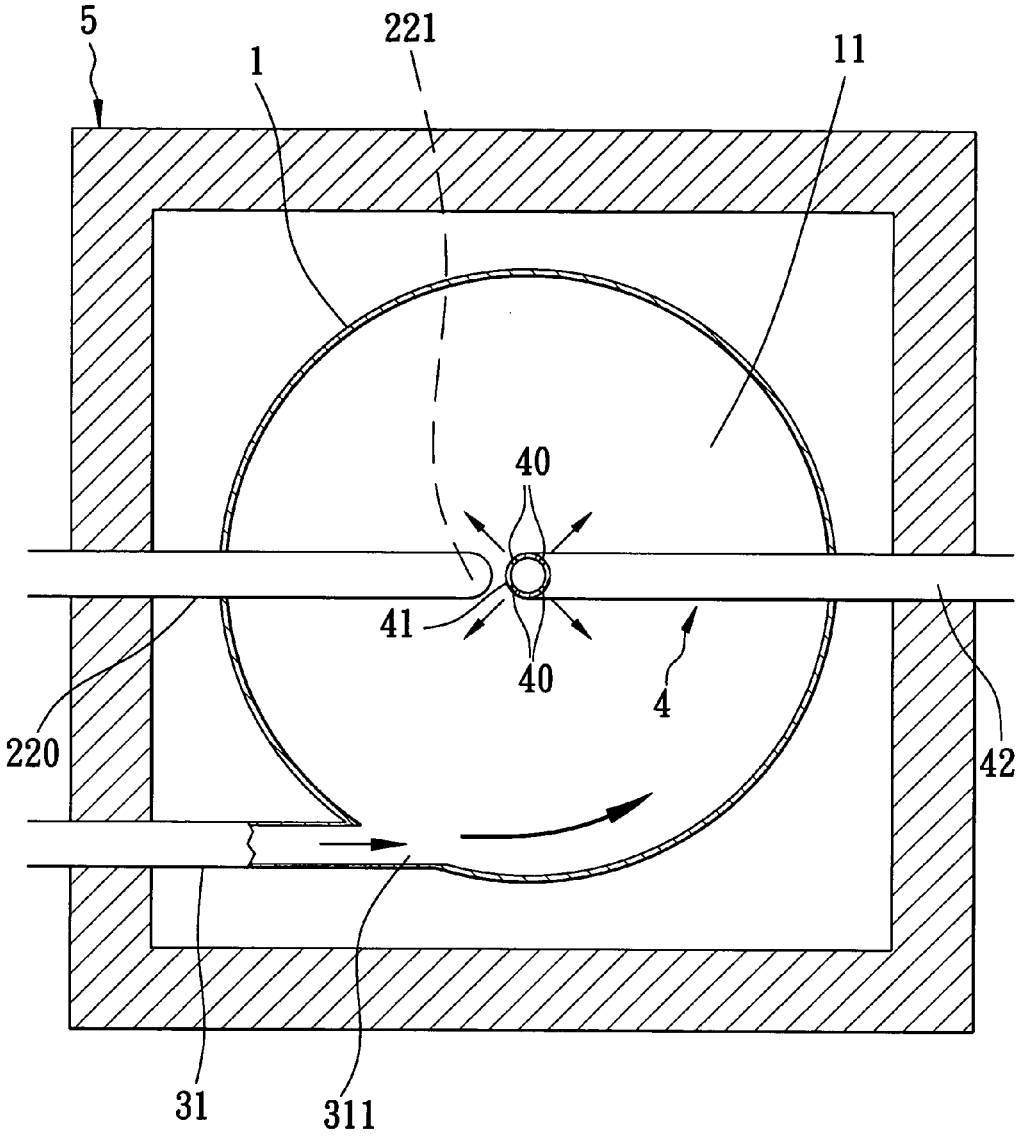
FIG. 4 is a schematic fragmentary top sectional view to illustrate how air is distributed through an air distributor in a furnace of the incinerator of FIG. 3.

FIGS. 3 and 4 illustrate the second preferred embodiment of the incinerator according to the present invention. The incinerator of this embodiment differs from the previous embodiment in that the air supply 3 includes first and second air blowers 34, 35. The transverse segment 42 of the air distributor 4 is directly connected to the first air blower 34. An air conduit 31 is connected to the furnace 1 and the second air blower 35.

With the inclusion of the air distributor 4 in the combustion chamber 11 in the furnace 1 of the incinerator of this invention, the drawback as encountered in the prior art can be eliminated.

With the invention thus explained, it is apparent that various modifications and variations can be made without departing from the spirit of the present invention.

I claim:

1. An incinerator for incinerating solid wastes, comprising:

a furnace that defines a combustion chamber therein;

a feed supply adapted for containing the solid wastes therein;

a feed-delivering conduit connected to said feed supply and said furnace so as to permit delivery of the solid wastes into said combustion chamber wherein said feed-delivering conduit has a laterally extending segment that extends in said transverse direction through said furnace, and that has a feed-discharging end disposed in said combustion chamber and opening downwardly, said transverse segment of said air distributor being disposed above said feed-discharging end, said elongated segment of said air distributor extending upwardly from said transverse segment in said longitudinal direction away from said feed-discharging end of said laterally extending segment of said feed-delivering conduit;

an air supply connected to said furnace for supplying air into said combustion chamber wherein said air supply includes an air blower, and an air conduit connected to said air blower and said furnace; and an air distributor that is disposed in said combustion chamber, that is connected to said air supply, and that has an elongated segment which extends in a longitudinal direction the same as a flow direction of combustion gases in said combustion chamber, and which is formed with a plurality of spaced apart holes distributed along said longitudinal direction, each of said holes opening in a transverse direction relative to said longitudinal direction so as to permit uniform distribution of air into said combustion chamber wherein said air distributor is in the form of an L-shaped pipe, and further has a transverse segment that extends from said elongated segment in said transverse direction and that is connected to said air conduit.

2. The incinerator of claim 1, wherein said elongated segment of said air distributor has a top end, said furnace being formed with spaced apart first and second air inlets which are connected to said air conduit, said first air inlet being disposed at an elevation substantially the same as that of said top end of said elongated segment, said second air inlet being disposed at an elevation below said feed-discharging end of said laterally extending segment of said feed-delivering conduit.

3. An incinerator for incinerating solid wastes, comprising:

a furnace that defines a combustion chamber therein;

a feed supply adapted for containing the solid wastes therein;

a feed-delivering conduit connected to said feed supply and said furnace so as to permit delivery of the solid wastes into said combustion chamber;

an air supply connected to said furnace for supplying air into said combustion chamber; and an air distributor that is disposed in said combustion chamber, that is connected to said air supply, and that has an elongated segment which extends in a longitudinal direction the same as a flow direction of combustion gases in said combustion chamber, and which is formed with a plurality of spaced apart holes distributed along said longitudinal direction, each of said holes opening in a transverse direction relative to said longitudinal direction so as to permit uniform distribution of air into said combustion chamber;

wherein said air supply includes a first air blower, said air distributor being in the form of an L-shaped pipe, and further having a transverse segment that extends from said elongated segment in said transverse direction and that is connected to said first air blower;

wherein said air supply further includes a second air blower and an air conduit that is connected to said furnace and said second air blower; and wherein said feed-delivering conduit has a laterally extending segment that extends in said transverse direction through said furnace, and that has a feed-discharging end disposed in said combustion chamber and opening downwardly, said transverse segment of said air distributor being disposed above said feed-discharging end, said elongated segment of said air distributor extending upwardly from said transverse segment in said longitudinal direction away from said feed-discharging end of said laterally extending segment of said feed-delivering conduit.

4. The incinerator of claim 3, wherein said elongated segment of said air distributor has a top end, said furnace being formed with spaced apart first and second air inlets which are connected to said air conduit, said first air inlet being disposed at an elevation substantially the same as that of said top end of said elongated segment, said second air inlet being disposed at an elevation below said feed-discharging end of said laterally extending segment of said feed-delivering conduit.

* * * * *